US009328970B2

(12) United States Patent
Nagura et al.

(10) Patent No.: US 9,328,970 B2
(45) Date of Patent: May 3, 2016

(54) COMPRESSING DEVICE

(71) Applicant: Kobe Steel, Ltd., Kobe-shi (JP)

(72) Inventors: Kenji Nagura, Takasago (JP); Hitoshi Takagi, Takasago (JP); Takuro Uba, Takasago (JP); Toshio Hirai, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 247 days.

(21) Appl. No.: 14/219,417

(22) Filed: Mar. 19, 2014

(65) Prior Publication Data

US 2014/0318747 A1 Oct. 30, 2014

(30) Foreign Application Priority Data

Apr. 24, 2013 (JP) ..... 2013-091104

(51) Int. Cl.

| | |
|---|---|
| ***F25D 9/00*** | (2006.01) |
| ***F28F 3/08*** | (2006.01) |
| ***F04B 15/08*** | (2006.01) |
| ***F04B 39/06*** | (2006.01) |
| ***F04B 39/12*** | (2006.01) |
| ***F28F 7/02*** | (2006.01) |

(52) U.S. Cl.

CPC . *F28F 3/08* (2013.01); *F04B 15/08* (2013.01); *F04B 39/06* (2013.01); *F04B 39/121* (2013.01); *F04B 39/122* (2013.01); *F04B 39/123* (2013.01); *F28F 7/02* (2013.01); *F04B 2015/0822* (2013.01)

(58) Field of Classification Search

CPC ..... F25B 9/004; F25B 1/00; F25B 13/00; F25B 2400/075; B64D 13/06

USPC ..... 62/401, 498, 510; 417/243; 165/121

See application file for complete search history.

(56) References Cited

U.S. PATENT DOCUMENTS

| | | | | |
|---|---|---|---|---|
| 2,192,654 | A * | 3/1940 | Simons | F25B 31/002 184/6.5 |
| 5,899,669 | A | 5/1999 | Van Grimberge | |
| 7,584,624 | B2 * | 9/2009 | Hwang | F25B 13/00 417/372 |
| 2004/0018632 | A1 | 1/2004 | Shabana et al. | |
| 2008/0060788 | A1 | 3/2008 | Kong | |
| 2010/0278665 | A1 | 11/2010 | Katano et al. | |
| 2010/0312035 | A1 * | 12/2010 | Ruettinger | B01J 23/002 585/852 |
| 2011/0052430 | A1 | 3/2011 | Dehnen et al. | |

FOREIGN PATENT DOCUMENTS

| | | | |
|---|---|---|---|
| JP | 2000-283668 | | 10/2000 |
| JP | 2006-90422 | A | 4/2006 |
| JP | 2007-239956 | A | 9/2007 |
| KR | 10-0434933 | B1 | 9/2004 |

OTHER PUBLICATIONS

The Extended European Search Report issued Oct. 21, 2014, in Application No. / Patent No. 14160828.1-1608.

* cited by examiner

*Primary Examiner* — Melvin Jones

(74) *Attorney, Agent, or Firm* — Oblon, McClelland, Maier & Neustadt, L.L.P.

(57) ABSTRACT

Provided is a compressing device including a compressor with a compressing unit compressing a gas and a heat exchanger, the heat exchanger including: a cooling unit that cools a gas compressed by the compressing unit; a connection path that connects the compressing unit to the cooling unit; and a connection path branch portion that is branched from a part of the connection path. The connection path branch portion includes an attachment portion that is provided in a surface different from a surface facing the compressor in the heat exchanger. An instrumentation device is directly and strongly attached to the attachment portion.

8 Claims, 6 Drawing Sheets

A-A

B-B

COMPRESSING DEVICE

BACKGROUND OF THE INVENTION

1. Field of the Invention

The present invention relates to a compressing device that compresses a gas.

2. Description of the Related Art

In recent years, there has been proposed a hydrogen station that supplies a hydrogen gas to a fuel-cell vehicle. The hydrogen station uses a compressing device, which supplies a hydrogen gas in a compressed state, in order to highly efficiently charge a hydrogen gas to the fuel-cell vehicle. The compressing device includes a compressor that compresses a hydrogen gas and a heat exchanger that cools the hydrogen gas which increases in temperature by the compression of the compressor. As the heat exchanger, for example, a plate-type heat exchanger disclosed in JP 2000-283668 A is proposed.

The plate-type heat exchanger is formed as a stacked body in which a plurality of plates are stacked, and a flow passageway circulating a fluid is formed between the stacked plates. Then, the heat exchanger exchanges heat between the fluids respectively flowing in the flow passageways adjacent to each other in the plate stacking direction.

SUMMARY OF THE INVENTION

Incidentally, the compressing device needs a plurality of pipes connecting the compressor to the heat exchanger. Incidentally, there is a concern in which the attachment strength of an instrumentation device such as a pressure gauge or a safety valve attached to a pipe may be degraded due to the vibration of the pipe when the compressing device is driven. Further, a pipe and a branch joint used to attach the instrumentation device and extending from the pipe are needed. In addition, the number of components increases, and the number of leakage inspection positions increases.

The present invention is made in view of the above-described problems, and an object thereof is to strongly attach the instrumentation device to the compressing device.

In order to attain the above-described object, a compressing device according to the present invention includes: a compressor that includes a compressing unit for compressing a gas; and a heat exchanger, wherein the heat exchanger includes a cooling unit that cools the gas compressed by the compressing unit, a connection path that connects the compressing unit to the cooling unit, and a connection path branch portion that is branched from a part of the connection path, the connection path branch portion including an attachment portion to which an instrumentation device is directly attached and which is provided in a first surface of the heat exchanger, the first surface being different from a second surface facing the compressor.

According to the compressing device, it is possible to strongly attach the instrumentation device compared to the compressing device in which the instrumentation device is attached to the pipe connecting the heat exchanger to the compressor. Further, it is possible to decrease the size of the compressing device by decreasing the number of the pipes.

In the compressing device, the heat exchanger may further include a supply path that leads a gas from a gas supply source to the compressor and a supply path branch portion that is branched from the supply path, and the supply path branch portion may include a supply path attachment portion to which a supply path instrumentation device is directly attached and which is provided in the first surface.

Further, in the compressing device, the heat exchanger may further include a discharge path that leads a gas compressed by the compressing device to a demand device and a discharge path branch portion that is branched from the discharge path, and the discharge path branch portion may include a discharge path attachment portion to which a discharge path instrumentation device is directly attached and which is provided in the first surface.

According to such a configuration, it is possible to further decrease the number of the instrumentation device attached to the pipe.

In the compressing device, the instrumentation device may be at least one of a pressure gauge and a safety valve.

In the compressing device, the compressor may include a plurality of the compressing units that are disposed in series, and the heat exchanger may include a plurality of the cooling units that cool the gas compressed by the plurality of compressing units, a plurality of the connection paths that connect the plurality of compressing units to the plurality of cooling units, and a single or a plurality of the connection path branch portions that are branched from at least a part of the plurality of connection paths.

In the compressing device, the heat exchanger may be disposed at the upper side of the compressor, and the first surface may be the upper surface of the heat exchanger.

In the compressing device, the heat exchanger may include a plurality of gas flow passageway groups in which the gas flows from the compressor and a plurality of cooling medium flow passageway groups in which a cooling medium flows to cool the gas flowing in the gas flow passageway groups, and the plurality of gas flow passageway groups and the plurality of cooling medium flow passageway groups may be alternately stacked.

According to this configuration, it is possible to further decrease the size of the compressing device.

In the compressing device, the compressor may include a suction valve that suctions the gas into the compressing unit, a discharge valve that discharges the gas from the compressing unit to the cooling unit, and a valve accommodation chamber that is disposed between the compressing unit and the heat exchanger and accommodates the suction valve and the discharge valve.

According to this configuration, it is possible to further decrease the size of the compressing device.

According to the present invention, it is possible to strongly attach the instrumentation device to the compressing device.

DESCRIPTION OF THE PREFERRED EMBODIMENTS

Figure 1:
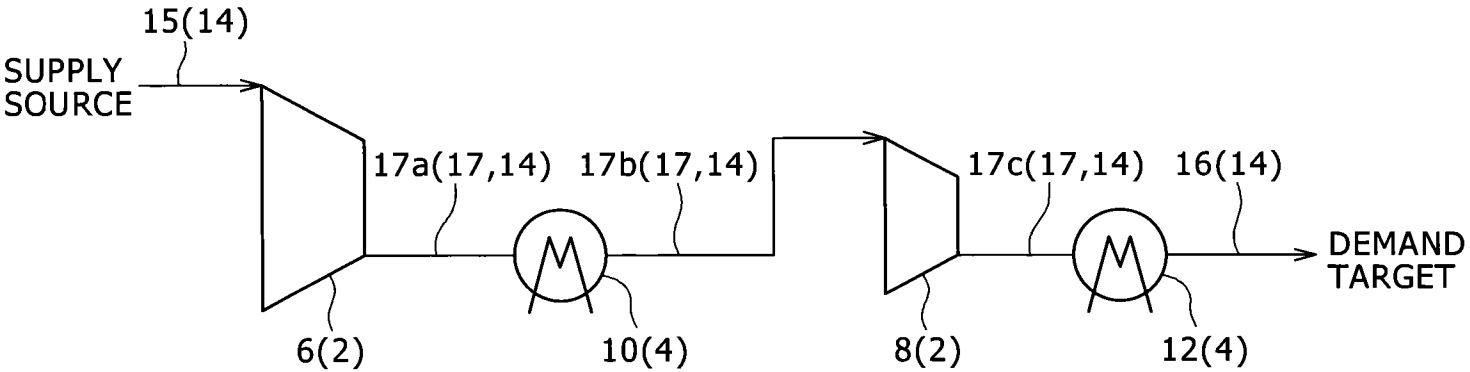
FIG. 1 is a conceptual diagram illustrating a reciprocation type compressing device according to a first embodiment of the present invention.

FIG. 1 is a conceptual diagram illustrating a reciprocation type compressing device 1 according to a first embodiment of the present invention. The compressing device 1 is disposed inside a hydrogen station, and is used to compress a hydrogen gas. The compressing device 1 includes a compressor 2 that compresses a hydrogen gas and a heat exchanger 4 that cools the hydrogen gas compressed by the compressor 2.

The compressor 2 includes a first compressing unit 6 that compresses the hydrogen gas and a second compressing unit 8 that further compresses the hydrogen gas compressed by the first compressing unit 6. The heat exchanger 4 includes a first cooling unit 10 that cools the hydrogen gas discharged from the first compressing unit 6 and a second cooling unit 12 that cools the hydrogen gas discharged from the second compressing unit 8. In the compressing device 1, the first compressing unit 6, the first cooling unit 10, the second compressing unit 8, and the second cooling unit 12 are connected by one flow passageway 14. As will be described later, the first compressing unit 6 and the second compressing unit 8 are actually formed inside one compressor 2 and the first cooling unit 10 and the second cooling unit 12 are actually formed inside one heat exchanger 4. Further, the flow passageway 14 is formed inside the heat exchanger 4. In the description below, a portion of the flow passageway 14 that leads the hydrogen gas from a hydrogen gas supply source to the first compressing unit 6 is referred to as a "supply path 15", and a portion thereof that leads the hydrogen gas from the second cooling unit 12 to a demand device is referred to as a "discharge path 16". Further, each of a portion that connects the first compressing unit 6 to the first cooling unit 10, a portion that connects the first cooling unit 10 to the second compressing unit 8, and a portion that connects the second compressing unit 8 to the second cooling unit 12 is referred to as a "connection path 17".

Figure 2:
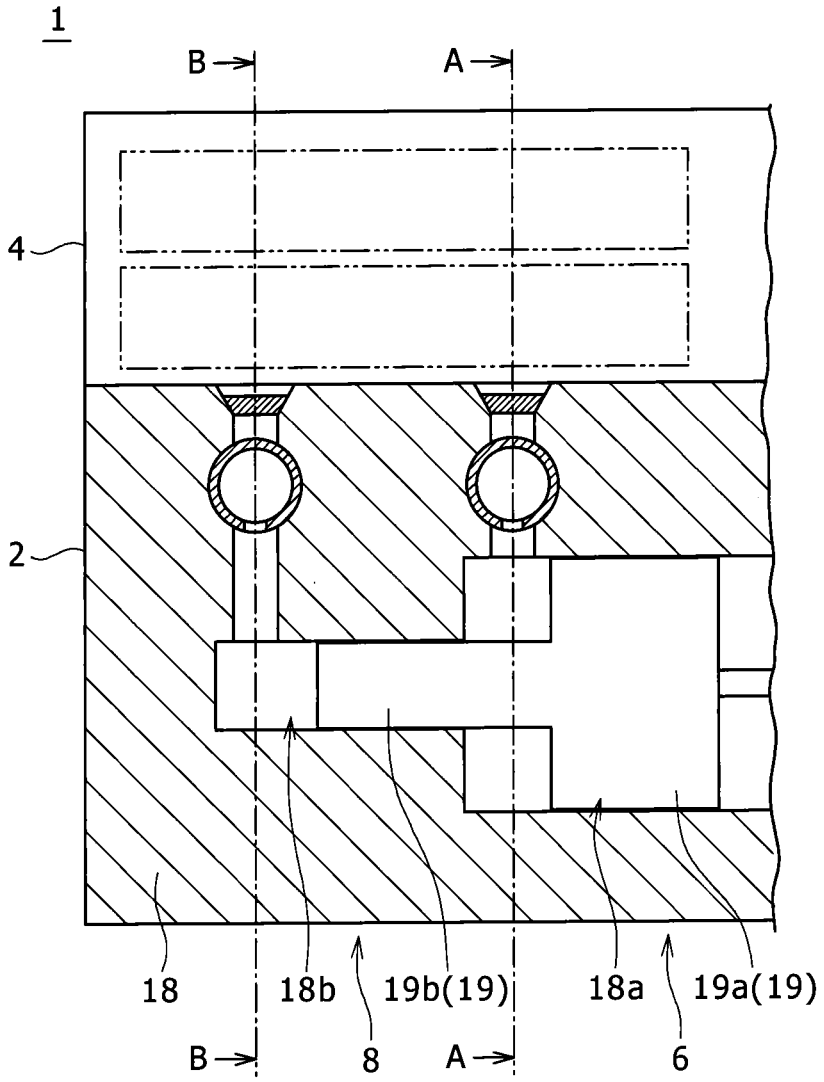
FIG. 2 is a cross-sectional view illustrating a part of the compressing device.

FIG. 2 is a cross-sectional view illustrating a part of the compressing device 1. In the compressing device 1, the heat exchanger 4 is disposed while contacting the upper portion of the compressor 2 in the gravity direction. The compressor 2 includes a cylinder portion 18 and a piston 19. The cylinder portion 18 includes a first cylinder chamber 18*a* and a second cylinder chamber 18*b*. The diameter of the first cylinder chamber 18*a* is larger than the diameter of the second cylinder chamber 18*b*. The first cylinder chamber 18*a* and the second cylinder chamber 18*b* are formed as a single connected space. The piston 19 includes a first piston portion 19*a* and a second piston portion 19*b*. The first piston portion 19*a* and the second piston portion 19*b* are formed as a single connected member. The diameter of the first piston portion 19*a* is larger than the diameter of the second piston portion 19*b*. The first piston portion 19*a* is disposed inside the first cylinder chamber 18*a*. The second piston portion 19*b* is disposed inside the second cylinder chamber 18*b*.

In the compressor 2, the first compressing unit 6 is formed by the first cylinder chamber 18*a* and the first piston portion 19*a*, and the second compressing unit 8 is formed by the second cylinder chamber 18*b* and the second piston portion 19*b*. In this way, the compressor 2 is a multi-stage-type compressor in which the compressing units 6 and 8 are connected in series. When the piston 19 is connected to a driving mechanism (not illustrated) and moves in a reciprocating manner inside the cylinder portion 18, the hydrogen gas is compressed by each of the first compressing unit 6 and the second compressing unit 8.

Figure 3:
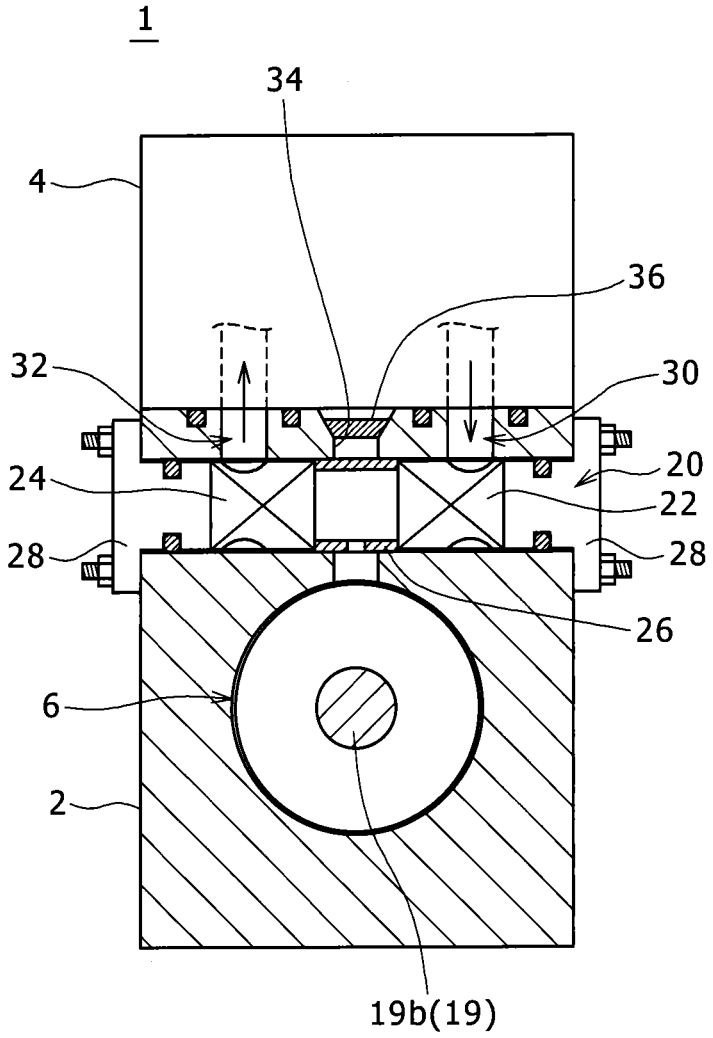
FIG. 3 is a cross-sectional view obtained by cutting the compressor at the position of the arrow A of FIG. 2 and is an external view of a heat exchanger.

FIG. 3 is a cross-sectional view obtained by cutting the compressor 2 at the position of the arrow A of FIG. 2 and is an external view of the heat exchanger 4. In the compressor 2, a first valve accommodation chamber 20 is formed between the first compressing unit 6 and the heat exchanger 4. The first valve accommodation chamber 20 extends within a horizontal plane in a direction perpendicular to the movement direction of the piston 19. The first valve accommodation chamber 20 accommodates a first suction valve 22 and a first discharge valve 24 with a first spacer 26 having a cylindrical shape interposed therebetween. The first suction valve 22, the first discharge valve 24, and the first spacer 26 are fixed by two flange portions 28. A first suction path 30 is formed between the first suction valve 22 and the heat exchanger 4, and the first suction valve 22 suctions the hydrogen gas from the heat exchanger 4 through the first suction path 30. A first discharge path 32 is formed between the first discharge valve 24 and the heat exchanger 4, and the first discharge valve 24 discharges the hydrogen gas from the first compressing unit 6 to the heat exchanger 4 through the first discharge path 32. Furthermore, a residual hole 34 that is formed at the upper side of the first spacer 26 is blocked by a plug 36.

Figure 4:
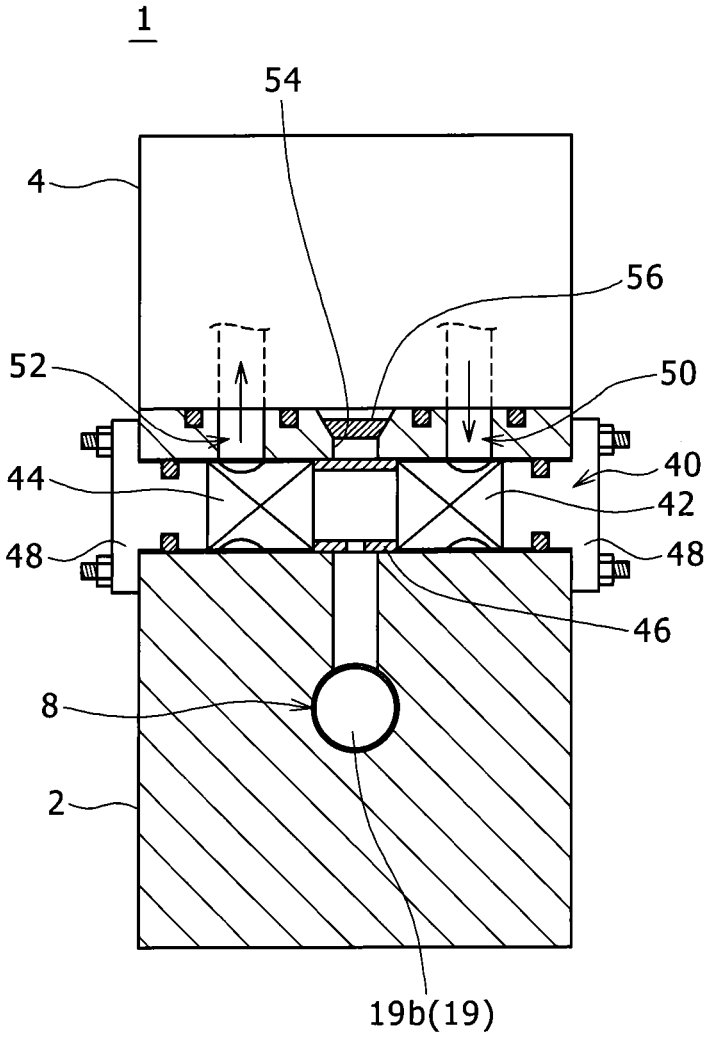
FIG. 4 is a cross-sectional view obtained by cutting the compressor at the position of the arrow B of FIG. 2 and is an external view of the heat exchanger.

FIG. 4 is a cross-sectional view obtained by cutting the compressor 2 at the position of the arrow B of FIG. 2 and is an external view of the heat exchanger 4. In the compressor 2, a second valve accommodation chamber 40 is formed between the second compressing unit 8 and the heat exchanger 4. The second valve accommodation chamber 40 has the same structure as that of the first valve accommodation chamber 20, and extends within a horizontal plane in a direction perpendicular to the movement direction of the piston 19. The second valve accommodation chamber 40 accommodates a second suction valve 42 and a second discharge valve 44 with a cylindrical spacer 46 interposed therebetween. The second suction valve 42, the second discharge valve 44, and the spacer 46 are fixed by two flange portions 48. A second suction path 50 is formed between the second suction valve 42 and the heat exchanger 4, and the second suction valve 42 suctions the hydrogen gas from the heat exchanger 4 through the second suction path 50. A second discharge path 52 is formed between the second discharge valve 44 and the heat exchanger 4. The second discharge valve 44 discharges the hydrogen gas from the second compressing unit 8 to the heat exchanger 4 through the second discharge path 52. Furthermore, a residual hole 54 formed in the second valve accommodation chamber 40 is blocked by a plug 56.

Figure 5:
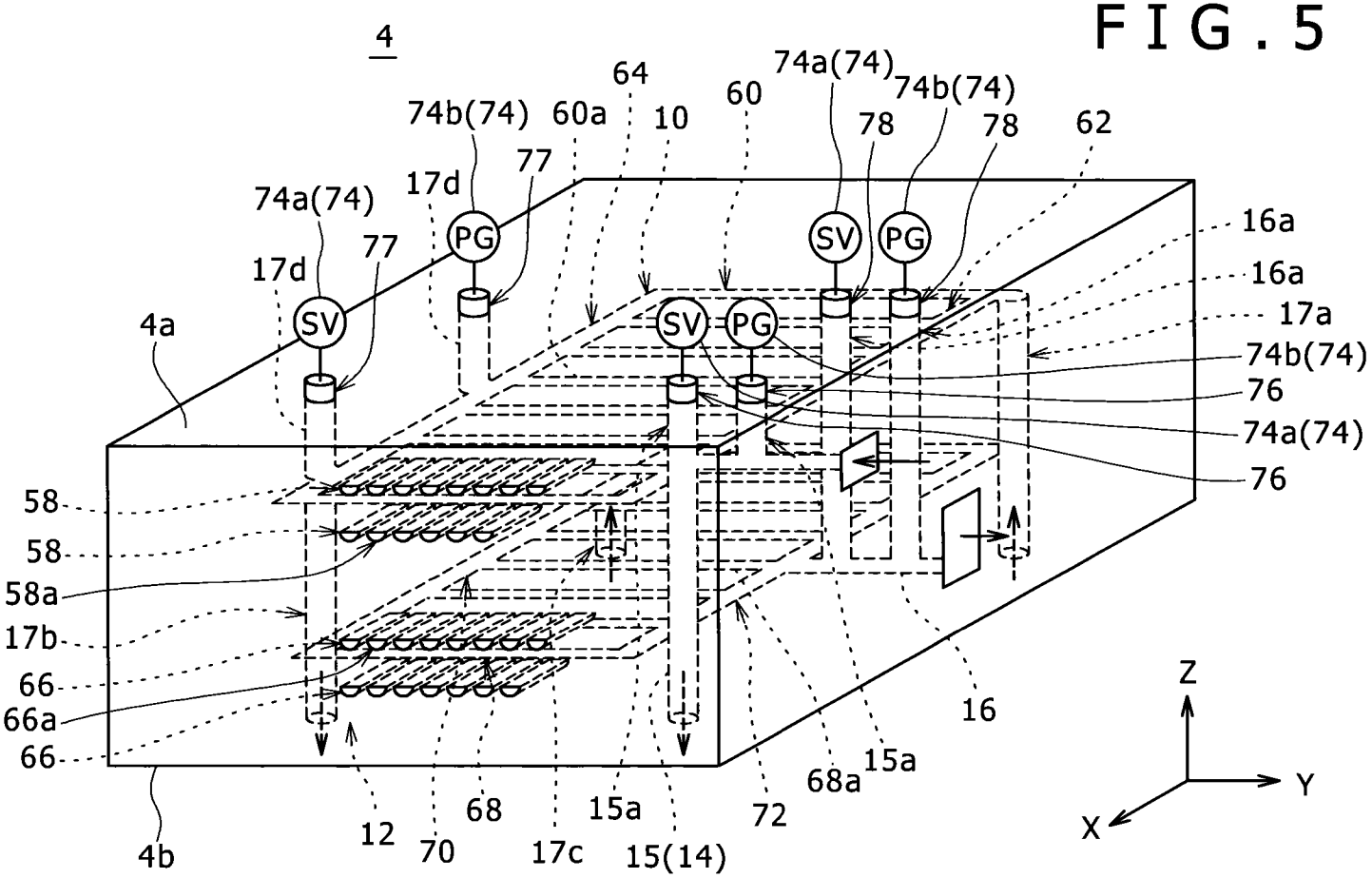
FIG. 5 is a view illustrating a structure of the heat exchanger.

FIG. 5 is a view illustrating a structure of the heat exchanger 4. The heat exchanger 4 is a micro channel heat exchanger having a rectangular parallelepiped outline, and is formed by stacking a plurality of plate-shaped members. The upper portion of the heat exchanger 4 is provided with the first cooling unit 10, and the lower portion thereof is provided with the second cooling unit 12. In the description below, the depth direction of FIG. 5 as the longitudinal direction of the heat exchanger 4 is referred to as the "X direction". The left and right direction of FIG. 5 as the width direction of the heat exchanger 4 is referred to as the "Y direction". The up and down direction of FIG. 5 as the height direction of the heat exchanger 4 is referred to as the "Z direction".

The first cooling unit 10 includes a plurality of first cooling medium flow passageway groups 58 that extend in the X direction, a plurality of first gas flow passageway groups 60 that extend in the Y direction, a plurality of gas distributing units 62 that extend in the X direction, and a plurality of gas collecting units 64 that extend in the X direction. Furthermore, FIG. 5 illustrates only a part of the first cooling medium flow passageway groups 58, the first gas flow passageway groups 60, the gas distributing units 62, and the gas collecting units 64. The same applies to the second cooling unit 12. Each of the first cooling medium flow passageway groups 58 is formed by a predetermined number of first cooling medium flow passageways 58*a* disposed in the Y direction. Water as a cooling medium flows in the first cooling medium flow passageway group 58.

Each of the first gas flow passageway groups 60 is formed by a predetermined number of first gas flow passageways 60*a* disposed in the X direction. The hydrogen gas flows in the first gas flow passageways 60*a*. The plurality of first gas flow passageway groups 60 and the plurality of first cooling medium flow passageway groups 58 are alternately stacked in the Z direction. The gas distributing units 62 connect the plurality of first gas flow passageways 60*a* at the (+Y-side) ends of the first gas flow passageway groups 60. The gas collecting units 64 connect the plurality of first gas flow passageways 60*a* at the (−Y-side) ends of the first gas flow passageway groups 60. In the first cooling unit 10, the hydrogen gas flowing through the first gas flow passageway groups 60 is cooled while exchanging heat with the water flowing in the first cooling medium flow passageway groups 58.

The second cooling unit 12 has substantially the same structure as that of the first cooling unit 10, and includes a plurality of second cooling medium flow passageway groups 66 that extend in the X direction, a plurality of second gas flow passageway groups 68 that extend in the Y direction, a plurality of gas distributing units 70 that extend in the X direction, and a plurality of gas collecting units 72 that extend in the X direction. Each of the second cooling medium flow passageway groups 66 is formed by a predetermined number of second cooling medium flow passageways 66*a* disposed in the Y direction. Each of the second gas flow passageway groups 68 is formed by a predetermined number of second gas flow passageways 68*a* disposed in the X direction. The plurality of second gas flow passageway groups 68 and the plurality of second cooling medium flow passageway groups 66 are alternately stacked in the Z direction. The gas distributing units 70 connect the plurality of second gas flow passageways 68*a* at the (−Y-side) ends of the second gas flow passageway groups 68. The gas collecting units 72 connect the plurality of second gas flow passageways 68*a* at the (+Y-side) ends of the second gas flow passageway groups 68. Even in the second cooling unit 12, the hydrogen gas flowing in the second gas flow passageway group 68 exchanges heat with the water flowing in the second cooling medium flow passageway group 66.

As described above, the flow passageway 14 is provided inside the heat exchanger 4. The supply path 15 extends from the right side surface of the heat exchanger 4 toward a lower surface 4*b* and is connected to the first suction path 30 of the first valve accommodation chamber 20 of FIG. 3. The supply path 15 is provided with a plurality of branch portions 15*a* that are branched from a part of the path toward the upper surface 4*a* of the heat exchanger 4. Hereinafter, the branch portion 15*a* is referred to as the "supply path branch portion 15*a*". The supply path branch portion 15*a* is opened to the upper surface 4*a* of the heat exchanger 4, and the opening portion is provided with an attachment portion 76 to which an instrumentation device 74 is attached. FIG. 5 illustrates a safety valve 74*a* and a pressure gauge 74*b* as the instrumentation device 74, but an instrumentation device such as a thermometer may be attached in actual. The same applies to attachment portions 77 and 78 of the other branch portions.

The connection path 17 (hereinafter, referred to as a "first connection path 17*a*") that connects the first cooling unit 10 to the first compressing unit 6 of FIG. 3 extends upward from the lower surface 4*b* of the heat exchanger 4. The opening of the first connection path 17*a* provided in the lower surface 4*b* is connected to the first discharge path 32 of the first valve accommodation chamber 20 of FIG. 3. The hydrogen gas is sent to the first gas flow passageway group 60 through the first connection path 17*a*. The gas distributing unit 62 of the first cooling unit 10 also exists at a part of the first connection path 17*a*.

The connection path 17 (hereinafter, referred to as a "second connection path 17*b*") that connects the first cooling unit 10 to the second compressing unit 8 of FIG. 4 extends toward the lower side of the heat exchanger 4. The opening of the second connection path 17*b* provided in the lower surface 4*b* of the heat exchanger 4 is connected to the second suction path 50 of the second valve accommodation chamber 40 of FIG. 4. The hydrogen gas that is cooled by the first gas flow passageway group 60 is sent to the second compressing unit 8 through the second connection path 17*b*. The gas collecting unit 64 also exists at a part of the second connection path 17*b*. The gas collecting unit 64 is provided with a plurality of branch portions 17*d* that are branched from a part of the path toward the upper surface 4*a* of the heat exchanger 4. Hereinafter, the branch portion 17*d* is referred to as the "connection path branch portion 17*d*". The connection path branch portion 17*d* is opened to the upper surface 4*a*, and the opening portion is provided with an attachment portion 77 to which the instrumentation device 74 is attached.

The connection path 17 (hereinafter, referred to as a "third connection path 17*c*") (connecting the second cooling unit 12 to the second compressing unit 8) extends upward from the lower surface 4*b* of the heat exchanger 4. The opening of the third connection path 17*c* provided in the lower surface 4*b* is connected to the second discharge path 52 of the second valve accommodation chamber 40 of FIG. 4. The hydrogen gas is sent to the second gas flow passageway group 68 through the third connection path 17*c*. The gas distributing unit 70 of the second cooling unit 12 also exists at part of the third connection path 17*c*.

The discharge path 16 extends in the (−Y) direction from the right side surface of the heat exchanger 4 and is connected to the second gas flow passageway group 68. The gas collecting unit 72 also exists at a part of the discharge path 16. The discharge path 16 is provided with a plurality of branch portions 16*a* that are branched from a part of the path toward the upper surface 4*a* of the heat exchanger 4. Hereinafter, the branch portion is referred to as the "discharge path branch portion 16*a*". The discharge path branch portion 16*a* is opened to the upper surface 4*a*, and the opening portion is provided with an attachment portion 78 to which the instrumentation device 74 is attached.

As described above, when the compressing device 1 is driven, the hydrogen gas is led from the supply source (see FIG. 1) to the first compressing unit 6 of FIG. 3 through the supply path 15, and the compressed hydrogen gas is sent to the first cooling unit 10 through the first connection path 17*a* so as to be cooled therein. The cooled hydrogen gas is sent to the second compressing unit 8 of FIG. 4 through the second connection path 17*b* so as to be further compressed by the second compressing unit 8. The hydrogen gas that is discharged from the second compressing unit 8 is sent to the second cooling unit 12 through the third connection path 17*c* so as to be cooled therein, and is led to the demand device through the discharge path 16.

In the compressing device 1, since the flow passageway 14 connecting the compressing units 6 and 8 to the cooling units 10 and 12 of the heat exchanger 4 is provided inside the heat exchanger 4 instead of the pipe, the number of the pipes may be decreased, and hence the size of the compressing device 1 may be decreased. Further, the leakage of the hydrogen gas from the pipe may be prevented.

While the compressing device 1 according to the first embodiment of the present invention has been described, the instrumentation device 74 is directly attached to the heat exchanger 4 in the compressing device 1. In this way, since the heat exchanger 4 serves as a so-called connecting block, the instrumentation device 74 may be strongly attached, and hence the breakage of the instrumentation device 74 or the attachment strength degradation caused by the vibration of the pipe may be prevented compared to the compressing device in which the instrumentation device is attached onto the pipe. Further, since the pipe and the branch joint used to attach the instrumentation device 74 to the pipe are not needed, the number of components may be decreased. As a result, the number of the leakage inspection positions may be decreased. Since the supply path branch portion 15*a*, the connection path branch portion 17*d*, and the discharge path branch portion 16*a* are provided inside the flow passageway 14, it is possible to easily provide the attachment portions 76 to 78 to which the instrumentation device 74 is attached.

Since the heat exchanger 4 has a structure in which the attachment portions 76 to 78 are disposed in the upper surface 4*a* of the heat exchanger 4, that is, the surface opposite to the surface facing the compressor 2 in the heat exchanger 4, it is possible to easily ensure a space that is used to process the supply path branch portion 15*a*, the connection path branch portion 17*d*, and the discharge path branch portion 16*a* in the heat exchanger 4.

In the compressing device 1, the pressure gauge 74*b* and the safety valve 74*a* are attached to each of the supply path branch portion 15*a* in which the hydrogen gas to be compressed flows, the connection path branch portion 17*d* of the second connection path 17*b* in which the hydrogen gas just cooled by the first cooling unit 10 flows, and the discharge path branch portion 16*a* in which the hydrogen gas cooled by the second cooling unit 12 flows. Accordingly, it is possible to prevent an increase in the size of the configuration of the instrumentation device 74 compared to the case where the instrumentation device is attached to the other portions of the flow passageway 14 in which the high-temperature hydrogen gas flows. Furthermore, only one of the pressure gauge 74*b* and the safety valve 74*a* may be attached to each of the branch portions 15*a*, 17*d*, and 16*a*.

While the embodiment of the present invention has been described, the present invention is not limited to the above-described embodiment, and may be modified into various forms.

For example, the attachment portions of the supply path branch portion, the discharge path branch portion, and the connection path branch portion may not be essentially provided in the upper surfaces as long as the attachment portions are provided in the surfaces different from the lower surfaces of the heat exchanger facing the compressor. The heat exchanger does not need to essentially contact the compressor. Even in this case, the instrumentation device may be strongly attached by providing the attachment portion in the heat exchanger. In the above-described embodiment, the connection path branch portion may be provided so as to be branched from the first and third connection paths in which the high-temperature hydrogen gas flows and the heat-resistant instrumentation device may be attached to the attachment portion of the connection path branch portion.

Figure 6:
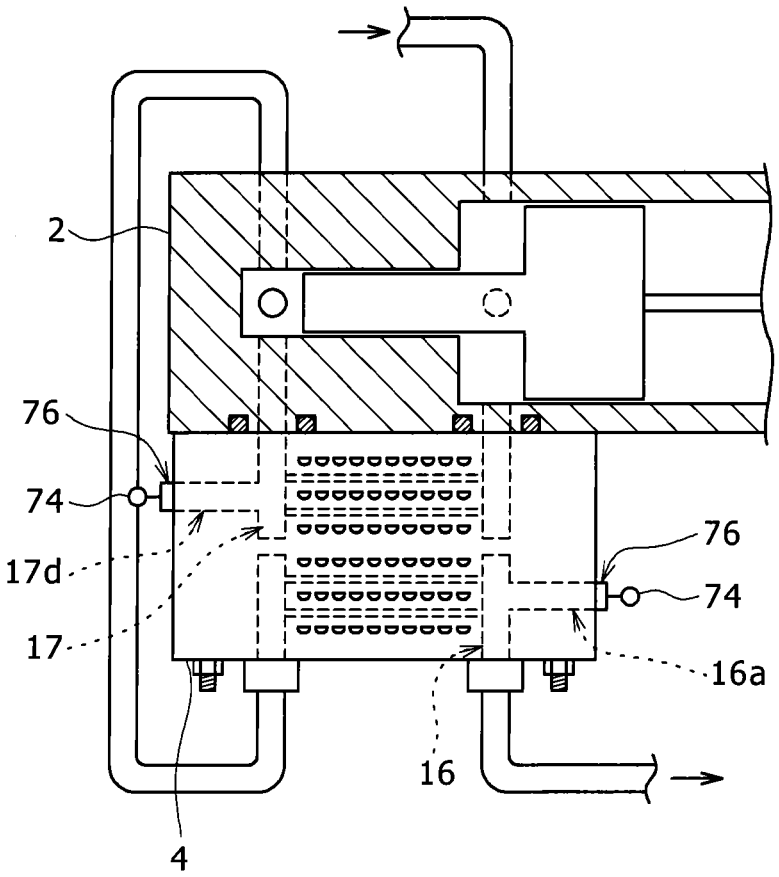
FIG. 6 is a schematic view illustrating a compressing device according to a modified example of the present invention.

The compressing device may have a structure in which the heat exchanger is disposed at the lower side or the lateral side of the compressor. For example, as illustrated in FIG. 6, in a case where the heat exchanger 4 is disposed at the lower side of the compressor 2, the side surface of the heat exchanger 4 is provided with the connection path branch portion 17*d* of the connection path 17 and the discharge path branch portion 16*a* of the discharge path 16, and the branch portions 17*d* and 16*a* are provided with the attachment portions 76 to which the instrumentation devices 74 are attached. In the heat exchanger 4, the first cooling unit 10 and the second cooling unit 12 may be disposed while being adjacent to each other in the horizontal direction.

The heat exchanger 4 is not limited to the micro channel heat exchanger. For example, another plate-type heat exchanger may be used or a heat exchanger other than the plate-type heat exchanger may be used.

A method of attaching the instrumentation device to the heat exchanger may be applied to the compressing device that includes one or more compressing units or may be applied to the compressing device that includes three or more compressing units. The method may be applied to another compressing device such as a screw-type compressing device or a turbo-type compressing device. The compressing device of the embodiment may be used for a gas such as a helium gas or a natural gas lighter than air other than the hydrogen gas or may be used to compress a carbon dioxide gas.

What is claimed is:

1. A compressing device comprising:

a compressor that includes a compressing unit for compressing a gas; and a heat exchanger, wherein the heat exchanger includes:

a cooling unit that cools the gas compressed by the compressing unit;

a connection path that connects the compressing unit to the cooling unit; and a connection path branch portion that is branched from a part of the connection path, the connection path branch portion including an attachment portion to which an instrumentation device is directly attached and which is provided in a first surface of the heat exchanger, the first surface being different from a second surface facing the compressor.

2. The compressing device according to claim 1, wherein the heat exchanger further includes:

a supply path that leads a gas from a gas supply source to the compressor; and a supply path branch portion that is branched from the supply path, and wherein the supply path branch portion includes a supply path attachment portion to which a supply path instrumentation device is directly attached and which is provided in the first surface.

3. The compressing device according to claim 1, wherein the heat exchanger further includes:

a discharge path that leads a gas compressed by the compressing device to a demand device; and a discharge path branch portion that is branched from the discharge path, and wherein the discharge path branch portion includes a discharge path attachment portion to which a discharge path instrumentation device is directly attached and which is provided in the first surface.

4. The compressing device according to claim 1, wherein the instrumentation device is at least one of a pressure gauge and a safety valve.

5. The compressing device according to claim 1, wherein the compressor includes a plurality of the compressing units that are disposed in series, and wherein the heat exchanger includes:

a plurality of the cooling units that cool the gas compressed by the plurality of compressing units;

a plurality of the connection paths that connect the plurality of compressing units to the plurality of cooling units; and a single or a plurality of the connection path branch portions that are branched from at least a part of the plurality of connection paths.

6. The compressing device according to claim 1, wherein the heat exchanger is disposed at the upper side of the compressor, and wherein the first surface is the upper surface of the heat exchanger.

7. The compressing device according to claim 1, wherein the heat exchanger includes:

a plurality of gas flow passageway groups in which the gas flows from the compressor: and a plurality of cooling medium flow passageway groups in which a cooling medium flows to cool the gas flowing in the gas flow passageway groups, and wherein the plurality of gas flow passageway groups and the plurality of cooling medium flow passageway groups are alternately stacked.

8. The compressing device according to claim 1, wherein the compressor includes:

a suction valve that suctions the gas into the compressing unit;

a discharge valve that discharges the gas from the compressing unit to the cooling unit; and a valve accommodation chamber that is disposed between the compressing unit and the heat exchanger and accommodates the suction valve and the discharge valve.

* * * * *